US006819770B2

(12) United States Patent
Niederdränk

(10) Patent No.: US 6,819,770 B2
(45) Date of Patent: Nov. 16, 2004

(54) HEARING AID WITH PORTION THEREOF INSERTED IN AUDITORY CANAL, WITH AUDITORY CANAL VENTILATION

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 209 days.

(21) Appl. No.: 10/226,748

(22) Filed: Aug. 23, 2002

(65) Prior Publication Data

US 2003/0059075 A1 Mar. 27, 2003

(30) Foreign Application Priority Data

Aug. 27, 2001 (DE) ..... 101 41 800

(51) Int. Cl.[7] ..... H04R 25/00
(52) U.S. Cl. ..... 381/322; 381/328
(58) Field of Search ..... 381/319, 322, 381/324, 325, 328, 330; 181/128, 129, 130, 135

(56) References Cited

U.S. PATENT DOCUMENTS 3,470,328 A * 9/1969 Daniels ..... 381/322
4,375,016 A * 2/1983 Harada ..... 181/135
5,068,901 A * 11/1991 Carlson ..... 381/325

FOREIGN PATENT DOCUMENTS

DE OS 199 42 707 3/2001

* cited by examiner

*Primary Examiner*—Suhan Ni
(74) *Attorney, Agent, or Firm*—Schiff Hardin LLP

(57) ABSTRACT

A hearing aid device to be worn in the ear or a hearing aid device with otoplastic to be worn in the ear, has at least two aeration channels in combination with flow resistances arranged in the aeration channels that promote a flow from the enclosed auditory canal volume toward the outside in at least one aeration channel and a flow into the enclosed auditory canal volume in at least one other aeration channel. A flow through the enclosed auditory canal volume results therefrom, so that an air exchange ensues. This improves the wearing comfort of the hearing aid device and contributes to the prevention of diseases caused by a poor ventilation of the auditory canal.

19 Claims, 2 Drawing Sheets

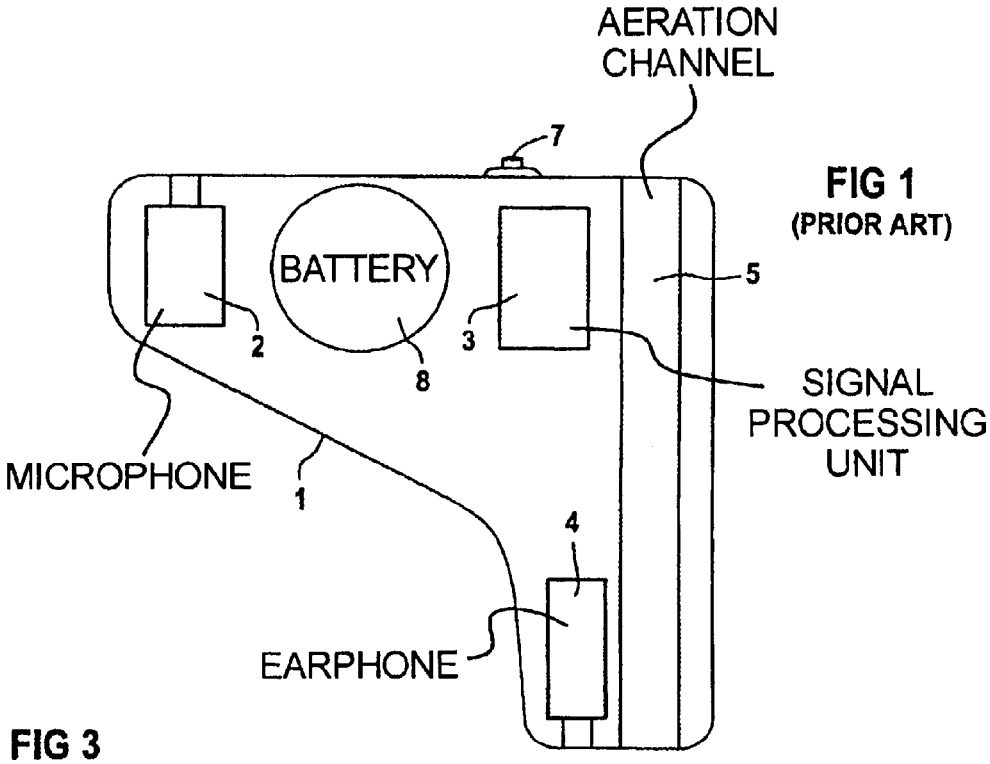
FIG 1
(PRIOR ART)
FIG 3
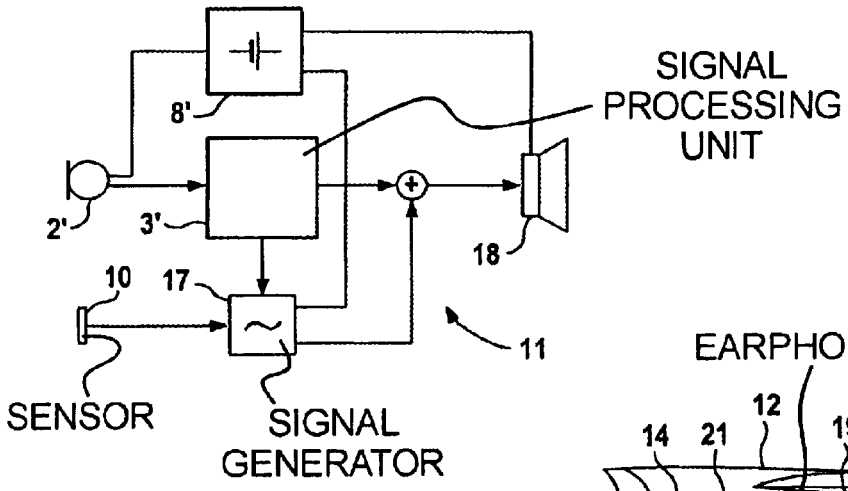
FIG 2
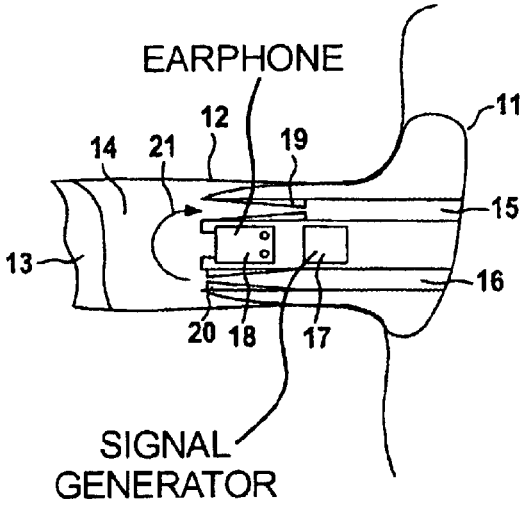

HEARING AID WITH PORTION THEREOF INSERTED IN AUDITORY CANAL, WITH AUDITORY CANAL VENTILATION

BACKGROUND OF THE INVENTION

1. Field of the Invention

The present invention is directed to a hearing aid device of the type which can be worn in the ear, or at the ear with an otoplastic worn in the ear, as well as to a method for operating such a hearing aid. In particular, the invention relates to a method and hearing aid allowing ventilation of the volume of the auditory canal which is closed by the hearing aid or by the otoplastic.

2. Description of the Prior Art

In the practical application of hearing aid devices, the auditory canal is closed in many instance by an otoplastic or by a hearing aid device seated in the auditory canal. In order to nonetheless assure a certain aeration of the enclosed auditory canal volume and in order to be able to counter the acoustic effects associated with a closed auditory canal, a small aeration channel, also referred to as ventilation opening or merely "vent", is integrated into the otoplastic or into the hearing aid device worn in the ear.

Limits, however, exist as to the size of this aeration channel from the acoustic side since too many sound components would exit the residual volume of the auditory canal through a large aeration channel and could thus proceed to the microphone of the hearing aid device. The result would be feedback-caused oscillations (feedback). Thus only an aeration channel having a comparatively small cross-section can usually be employed.

Heretofore, it has been up to the hearing aid acoustician to integrate a vent into a hearing aid device that is matched to the hearing impairment and further individual conditions of a hearing aid user. For insuring higher acoustic stability comparatively small ventilation openings have generally been used, resulting in an inadequate aeration of the enclosed auditory canal volume.

German OS 199 42 707 discloses a hearing aid device to be worn in the ear or a hearing aid device with otoplastic to be worn in the ear wherein an aeration channel is present. Additionally, means for throttling or closing the aeration channel are present in this known hearing aid device. The setting of this means ensues with corresponding operating elements for a hearing aid device worn at the ear or by means of the signal processing unit of the hearing aid device or by programming of the hearing aid device.

A disadvantage of such known hearing aid devices to be worn in the ear or hearing aid devices with otoplastic to be worn in the ear is the inadequate aeration of the auditory canal given the usually small ventilation openings. Poor wearing comfort or even inflammation in the auditory canal thus frequently arise.

SUMMARY OF THE INVENTION

An object of the invention to improve the aeration of the auditory canal given for hearing aid device to be worn in the ear or a hearing aid device with otoplastic to be worn in the ear.

The above object is achieved in a hearing aid device to be worn in the ear or a hearing aid device with otoplastic to be worn in the ear, having at least one input transducer for the pickup of an acoustic or electromagnetic input signal and conversion into an electrical signal, a signal processing unit for processing and amplification of the electrical signal and an earphone for converting the electrical signal into an acoustic signal, at least one first aeration channel and at least one second aeration channel for ventilating the auditory canal volume enclosed by the hearing aid device or the otoplastic. The aeration channels have respective structures allocated to them for promoting a flow direction through the aeration channel, for promoting the flow of air out of the enclosed auditory canal volume in the first aeration channel and for promoting the flow of air into the enclosed auditory canal volume in the second aeration channel.

Further, this object is achieved in a method for the operation of a hearing aid device to be worn in the ear or a hearing aid device with otoplastic to be worn in the ear, wherein a drive signal having a signal frequency in an inaudible frequency range is generated and superimposed on the electrical signal and output via the earphone into the auditory canal for the active ventilation of the auditory canal.

The hearing aid device of the invention is, for example, a hearing aid worn in the ear (ITE), a hearing aid worn behind the ear (BTE) or on the body that is connected to an otoplastic worn in the ear, a communication device worn in the ear, a part of a communication system worn in the ear, for example a headset worn in the ear for connection to a mobile telephone, etc. A part that closes the auditory canal is arranged in the auditory canal in all of these devices. The natural ventilation of the auditory canal is thus largely suppressed.

The hearing aid device of the invention has an input transducer, for example a microphone, an auditory coil or an antenna that picks up the input signal and converts it into an electrical signal. The electrical signal is further-processed in a signal processing unit and is usually amplified with a gain that is dependent on the frequency. An earphone converts the electrical signal processed in this way into an acoustic signal that is emitted into the auditory canal of a user.

In a hearing aid device worn in the ear, the earphone is arranged in the hearing aid device, and thus in the auditory canal. The situation is different in a hearing aid device with an otoplastic. Here, the earphone can be arranged in the otoplastic or alternatively can be arranged outside the auditory canal, for example within a hearing aid device worn behind the ear. The sound conduction from the earphone into the auditory canal ensues via a sound conduit connected to the otoplastic.

As a result of the (at least two) aeration channels in combination with flow resistances arranged in the aeration channels that promote a flow from the enclosed auditory canal volume toward the outside in at least one aeration channel and promote a flow into the enclosed auditory volume in at least one other aeration channel, a flow through the enclosed auditory canal volume results overall, so that an air exchange ensues therein. This improves the wearing comfort of the hearing aid device and contributes to avoiding diseases caused by a poor ventilation of the auditory canal.

The flow is driven, for example, by movements and volume changes of the auditory canal associated therewith of the kind produced when talking or chewing.

In a preferred version of the invention, a further signal—the drive signal—is emitted as a component of the acoustic output from the earphone in addition to the processed signal, this further signal being in an inaudible frequency range and therefore not being perceived by the user. By interaction with the flow resistances in the aeration channels with the earphone, a membrane pump thereby is created that causes to an air flow through the enclosed auditory canal volume, and thus effects an active ventilation of the enclosed auditory canal volume.

A signal generator, for example a sine generator, can be used to generate the drive signal. The ventilation effect produced by the earphone thereby improves with increasing amplitude of the drive signal, for which reason an optimally high amplitude is preferred. A movement of the earphone membrane, preferably a low-frequency movement thereof, that is not produced by the payload signal arises in this way, this seeing to a uniform flow of air into and out of the earphone. During operation of the hearing aid device, however, care must be exercised to be sure that the earphone membrane does not reach its full modulation due to the superimposition of the payload signal with the drive signal, since audible artifacts thus would be generated.

A special structuring of the aeration channels can achieve a privileged pass direction of the aeration channels. For example, an aeration channel can gradually and continuously narrow in one pass direction and in turn abruptly expand to the original circumference. The same measure is undertaken in the second aeration channel—preferably arranged parallel to the first; however the gradual and continuous constriction ensues in the other direction. Given, for example, an elevated pressure in the enclosed auditory canal volume compared to the ambient pressure, the channel that narrows steadily and gradually toward the outside offers lower flow resistance than the aeration channel having an abrupt constriction facing toward the enclosed volume. On average, an air flow toward the outside thus ensues through the first aeration channel, and an air flow toward the inside ensues through the second aeration channel. Overall, an air flow thus is produced through the enclosed auditory canal volume, and thus an air exchange. The functioning thus mimics that of a membrane pump.

Usually no specific earphones are required for the operation of a hearing aid device of the invention. For earphones that are usually utilized, a pressure compensation between the two separate air volumes separated by the membrane is not provided for the dynamic operating condition. Microbores may be arranged laterally next to the membrane for static pressure compensation, but these have no influence on the dynamic operation.

In order to promote the flow in one direction through an aeration channel, valves or flaps can be arranged at an input of the aeration channel or within the aeration channel according to one version of the invention. Although valves or flaps require a higher mechanical outlay for manufacture, they nonetheless guarantee that the flow through the aeration channel ensues nearly exclusively in one direction.

Automatically actuatable valves or flaps are even more mechanically complicated but are even more efficient. These valve or flaps have electrical or magnetic miniature drives allocated to them that are preferably driven directly with the drive signal for the earphone. The valves or flaps are thus opened or closed with the clock of the drive signal, with the valves or flaps in the one aeration channel being opened while the valves or flaps in the other aeration channel close.

Preferably, the miniature drives—but also the valves or flaps—are at least partly manufactured in micro-structure technology. Such methods allow an economical manufacture of high unit numbers of nearly arbitrarily small miniature actuators.

The drive signal for driving the earphone in a hearing aid device of the invention preferably is generated with a signal generator. This, for example, can be a sine generator, however, other drive signals also come into consideration, for instance square-wave signals. In order to be able to adapt the aeration to the individual needs of a user, the amplitude and/or frequency of the drive signal are advantageously adjustable. For example, the setting can ensue by programming the hearing aid device. This allows the air volume to be exchanged per time unit to be approximately set.

In an advantageous embodiment of the invention the setting of the drive signal ensues dependent on characteristics of the input signal or the electrical signal. The drive signal should have a relatively high amplitude for achieving a good ventilation effect. It is superimposed on the processed signal and is emitted as an output via the earphone. Particularly given a processed signal with a comparatively high amplitude, there is thus the risk of an overdrive of the earphone, which would generate audible artifacts. By acquiring the signal level of the input signal or the amplitude of the electrical signal, overdrive can be prevented by reducing the amplitude of the drive signal given an electrical signal with a high amplitude. As warranted, the drive signal can even be completely turned off given an electrical signal with an especially high amplitude. In a very quiet acoustic environment, further, the frequency and/or the amplitude of the drive signal can be reduced in order to reduce or avoid flow noises potentially produced by the active aeration.

The setting of the drive signal dependent on the auditory program that has been set is also possible. For example, the ventilation activity is throttled in case of an auditory program for a quiet environment.

In a further embodiment of the invention, a sensor is provided for acquiring at least one characteristic of the auditory canal volume enclosed by the hearing aid device worn in the ear or the otoplastic worn in the ear. For example, the size of the enclosed auditory canal volume or the relative humidity in the enclosed auditory canal volume can be measured with this sensor. In response thereto, the ventilation activity is adapted to the characteristic measured in this way. Given a relatively high relative humidity in the auditory canal, for example, the ventilation activity can be increased by increasing the frequency of the drive signal.

DESCRIPTION OF THE DRAWINGS

FIG. 1 illustrates a hearing aid device to be worn in the ear having an aeration channel according to the prior art.

FIG. 2 illustrates a hearing aid device to be worn in the ear having two aeration channels according to the invention;

FIG. 3 is a block circuit diagram of the hearing aid device according to FIG. 2.

DESCRIPTION OF THE PREFERRED EMBODIMENTS

Figure 4:
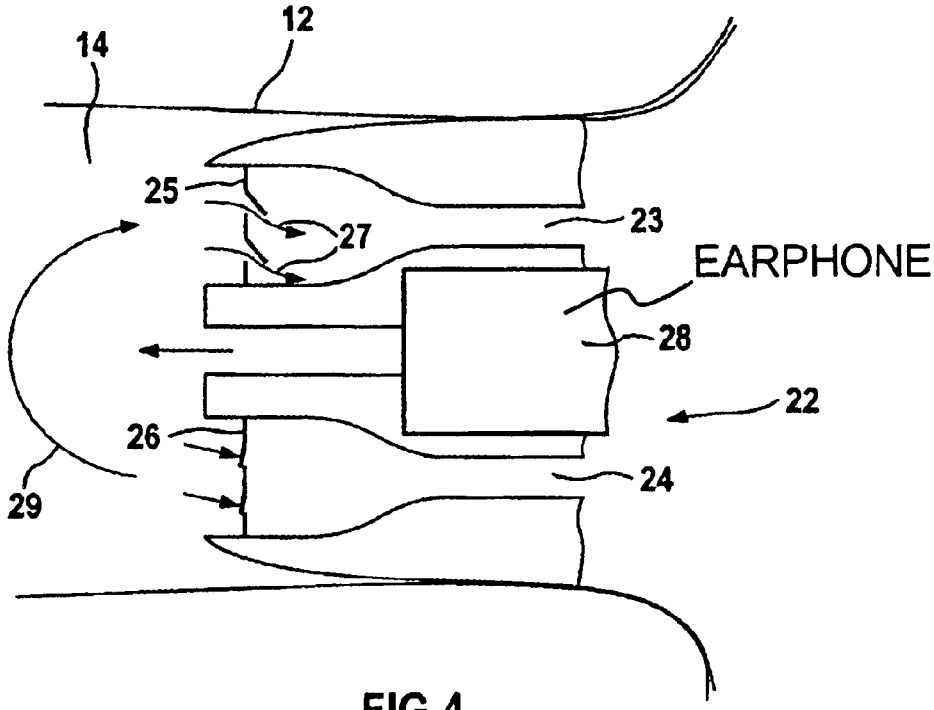
FIG. 4 illustrates flaps that are attached in two aeration channels arranged in parallel.

FIG. 1 schematically shows a hearing aid device 1 of the prior art to be worn in the ear. An acoustic signal is picked up via a microphone 2 and converted into an electrical signal. The electrical signal is supplied to a signal processing unit 3. The electrical signal is processed in the signal processing unit 3 and amplified dependent on the signal frequency. A certain degree of selectivity in the processing of the signal can be effected by the hearing aid wearer via a push button. The processed electrical signal is converted back into an acoustic signal via an earphone 4 and is emmitted into the auditory canal of a hearing aid user. The electrical components of the hearing aid device 1 are connected to a battery 8 for voltage supply.

For ventilating the auditory canal volume enclosed by the hearing aid device 1 worn in the ear, the hearing aid device has an aeration channel 5 passing through it. The aeration channel represents a bypass to the electro-acoustic signal path through the hearing aid device 1. In specific acoustic situations, for example given a low acoustic amplification of the hearing aid device 1 due to a loud sound environment, this bypass dominates over the signal path through the hearing aid device 1. This can lead to certain functions of the hearing aid device 1 such as, for example, a desired directional effect or a reduction of unwanted noise, to be implemented to only a limited extent. Moreover, the aeration channel 5 can also cause feedbacks between the earphone 4 and the microphone 2. In order to avoid these disadvantages, the aeration channel 5 is usually implemented with only a comparatively small cross-section. The disadvantage occurs, however, that only a slight ventilation effect in the enclosed auditory canal volume can be achieved by means of the aeration channel.

In a highly simplified and schematic illustration, FIG. 2 shows the basic components of a hearing aid 11 of the invention to be worn in the ear. The hearing aid device 11 extends deeply into the auditory canal of a hearing aid user, an auditory canal volume 14 thus being enclosed between the hearing aid device 11 and the tympanic membrane 13. The hearing aid device 11 suppresses the natural air circulation in the auditory canal 12 that occurs in a natural way due to the heating of the air as a result of body warmth. In order to nonetheless achieve a ventilation of the enclosed auditory canal volume 14, two aeration channels 15 and 16 are provided in the hearing aid device 11. The openings of the aeration channels 15 and 16 directed toward the inside of the auditory canal 12 lie as far apart as possible in order to achieve an optimally good ventilation of the entire enclosed auditory canal volume 14. Further, the aeration channels 15 and 16 are structured in the region of these openings. In the exemplary embodiment, the aeration channels narrow steadily and then abruptly open to their original width. Due to this structuring, a flow resistance is created that is dependent on the flow direction of the air through the aeration channel. The air experiences less of a flow resistance in the direction of the gradually and steadily increasing taper than in the opposite direction. Volume changes of the enclosed auditory canal volume 14 that, for example, are produced by chewing or speaking thus produce a pump effect in combination with the different flow resistances, this pump effect causing a flow through the enclosed auditory canal volume 14.

A simplified block circuit diagram of the hearing aid device according to FIG. 2 is shown in FIG. 3. As is usual in hearing aid devices, the hearing aid device 11 also has a microphone 2' for picking up an acoustic input signal and converting it into an electrical signal, a signal processing unit 3' for processing and frequency-dependent amplification of the input signal, an earphone 18 for converting the processed electrical signal into an acoustic output signal as well as a battery 8' for the voltage supply of the hearing aid device 11. In a preferred version of the invention, the hearing aid device 11 also has a signal generator 17. This generates a signal, preferably a sinusoidal signal, having a frequency in the inaudible frequency range. For example, this is a signal with a signal frequency of 10 Hz and optimally high amplitude. This signal is superimposed on the actual processed signal that is converted into an output by the earphone 18. The signal generator 17 is fashioned such that a full modulation of the earphone 18 does not occur due to the superimposition of the processed signal with the drive signal. An earphone membrane arranged in the earphone 18 performs a uniform pump motion as a result of the drive signal. In this way, an over-pressure or under-pressure relative to the ambient air that changes with the frequency arises in the enclosed auditory canal volume. As also can be seen from FIG. 2, the structural elements 19 and 20 are oppositely directed in the parallel aeration channels 15 and 16, i.e. the structural element 19 in the aeration channel 15 tapers increasingly in the direction of the outside of the auditory canal 12 and the structural element 20 in the aeration channel 16 tapers increasingly in the direction of the inside of the auditory canal 12. Given an over-pressure in the auditory canal volume 14, more air flows on average through the aeration channel 15 from inside to outside than through the aeration channel 16. Given an under-pressure in the enclosed auditory canal volume 16, more air on average flows through the aeration channel 16 into the enclosed auditory canal volume 14 than through the aeration channel 15. As a result of the pump motion of the earphone membrane of the earphone 18, a uniform air flow through the enclosed auditory canal volume 14 thus is achieved overall, as indicated by the arrow 21.

The hearing aid device 11 according to FIG. 3 additionally can include a sensor 10 directed into the enclosed auditory canal volume. The relative humidity in the enclosed auditory canal volume can be acquired with the sensor 10 and be supplied to the signal generator 17. Frequency and amplitude of the drive signal output by the signal generator 17 are then also determined dependent on this sensor signal, with frequency and/or amplitude of the drive signal being increased with increasing relative humidity.

The invention thus contributes to that the natural air circulation through the auditory canal 12 is not suppressed given a hearing aid device 11 worn in the ear. The enhances the wearing comfort and helps avoid inflammations as a consequence of poor ventilation.

The arrangement and fashioning of the aeration channels 15 and 16 and the structural elements 19 and 20 shown in FIG. 2 are only examples. A number of possible variations are conceivable within the scope of the invention. FIG. 4 shows another exemplary embodiment thereof. In this embodiment as well, a hearing aid device 22 (only partly shown) that is arranged in the auditory canal 12 encloses an auditory canal volume 14. Differing from FIG. 2, however, flaps 25 and 26 (only schematically shown in the drawing) that open given a pressure gradient in one direction and close given a pressure gradient in the other direction are located at the openings of two aeration channels 23 and 24 directed into the auditory canal. Due to the opposite orientations of the respective flaps 25 and 26 in the aeration channels 23 and 24, the flaps 25 are opened whereas the flaps 26 are closed given a pressure gradient from inside to outside in the auditory canal 12. As indicated by the arrows 27, air can flow out through the aeration channel 23 in this operating condition as a result, whereas no air exchange ensues through the aeration channel 24. Due to the further movement of the earphone membrane of the earphone 28 as a result of the drive signal, an under-pressure subsequently arises in the enclosed auditory canal volume 14, so that the flaps 26 open and air flows through the aeration channel 24 into the enclosed auditory canal volume. In contrast thereto, the flaps 25 are closed in this operating condition. Overall, the air circulation indicated by the arrow 29 derives as a result of the pump motion of the membrane of the earphone 28.

Differing from the structuring of the aeration channels according to FIG. 2, the flap arrangement shown in FIG. 4 requires a greater manufacturing outlay. In return, however, this guarantees an air flow through the aeration channels 23 and 24 in nearly only one respective direction. This improves the air circulation.

Figure 5:
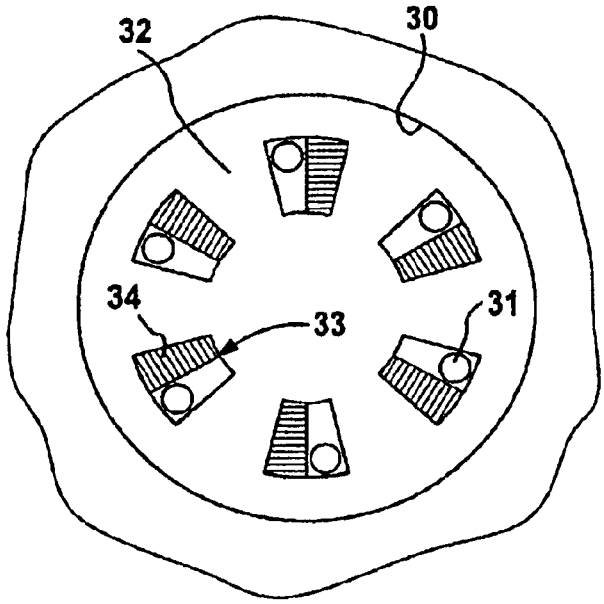
FIG. 5 is a schematic view of an arrangement composed of a carrier with a number of passages and swivel elements for opening and closing an aeration channel.

The valve arrangement shown in FIG. 5 is even more mechanically complicated but provides a nearly perfect opening and closing action. A carrier 32 is introduced into an aeration channel 30 and is provided with passages 31. A number of valves 33 arranged in parallel effect the opening or closing of the aeration channel 30. Slide elements 34 introduced into the carrier 32 are each slideable for a complete opening or closing of the respective passage allocated to each slide element 34. The carrier 32 is preferably composed of a semiconductor material into which the slide elements 34 are introduced. The actuation of the slide elements 34 ensues on the basis of electromagnetic forces. The control of the valves can be directly coupled with the drive signal for the control of the earphone membrane (as can the flaps in the embodiment of FIG. 4 for the active drive thereof).

According to the invention, the valve arrangement shown in FIG. 5 is also utilized in pairs in a number of aeration channels, with the valves controlled such that the valves in one aeration channel are closed whereas they are opened in the other aeration channel. The effect then corresponds to that shown in FIG. 4, but with an even better opening or closing action compared to the flap arrangement.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid device comprising:

an acousto-electrical transducer for converting incoming audio signals into an electrical signal;

a signal processor supplied with said electrical signal for amplifying and processing said electrical signal to produce a processed signal;

an electro-acoustical transducer supplied with said processed signal for converting said processed signal into an acoustic output;

an insertable element adapted for insertion in an auditory canal for communicating said acoustic output into said auditory canal, said insertable element, when inserted in the auditory canal, closing a volume in said auditory canal between said insertable element and the tympanic membrane; and said insertable element having a first aeration channel and a second aeration channel therein proceeding from an exterior of said insert to said volume, and a flow promoting arrangement for promoting a flow of air in a flow direction out of said volume in said first aeration channel and in a flow direction into said volume in said second aeration channel.

2. A hearing aid as claimed in claim 1 comprising a housing adapted for insertion in said auditory canal, said housing containing said acousto-electrical transducer, said signal processor and said electro-acoustical transducer, and wherein said insertable element comprises a portion of said housing.

3. A hearing aid as claimed in claim 1 further comprising a housing adapted to be worn externally of said auditory canal, said housing containing said acousto-electrical transducer, said signal processor and said electro-acoustical transducer, and wherein said insertable element comprises an otoplastic connected to said housing.

4. A hearing aid as claimed in claim 1 further comprising a drive signal generator which generates a drive signal having a signal frequency at an inaudible frequency range, said drive signal being superimposed on said processed signal and emitted, as a component of said acoustical output, by said electro-acoustical transducer for mechanically interacting with air in said volume to assist said flow promoting arrangement in promoting said flow.

5. A hearing aid as claimed in claim 1 wherein said first aeration channel has an internal structure for promoting said flow in said flow direction out of said volume and wherein said second aeration channel has an internal structure for promoting said flow in said flow direction into said volume.

6. A hearing aid as claimed in claim 1 wherein said first aeration channel has at least one flap therein which automatically opens given a pressure gradient in said flow direction out of said volume and which automatically closes given a pressure gradient opposite to said flow direction out of said volume, and wherein said second aeration channel has at least one flap therein which automatically opens given a pressure gradient in said flow direction into said volume and which automatically closes given a pressure gradient opposite to said flow direction into said volume.

7. A hearing aid as claimed in claim 4 wherein said first aeration channel has at least one actively driven element therein which automatically opens given a pressure gradient in said flow direction out of said volume and which automatically closes given a pressure gradient opposite to said flow direction out of said volume, and wherein said second aeration channel has at least one actively driven element therein which automatically opens given a pressure gradient in said flow direction into said volume and which automatically closes given a pressure gradient opposite to said flow direction into said volume, said driven elements being driven by said drive signal.

8. A hearing aid as claimed in claim 7 wherein said driven elements are selected from the group consisting of valves and flaps, and further comprising a plurality of miniature drives respectively connected to said driven elements for operating said driven elements, said miniature drives being selected from the group consisting of electrical miniature drives and magnetic miniature drives.

9. A hearing aid as claimed in claim 8 wherein each driven element and miniature drive connected thereto forms a drive arrangement, and wherein at least a portion of each drive arrangement is manufactured with a micro-structuring technique.

10. A hearing aid as claimed in claim 4 wherein said drive signal has an amplitude, and wherein said signal generator is controllable to adjust at least one of said amplitude and said frequency of said drive signal.

11. A hearing aid as claimed in claim 4 wherein said signal processor identifies a characteristic of said electrical signal and controls said signal generator to set said drive signal dependent on said characteristic.

12. A hearing aid as claimed in claim 4 further comprising a sensor for identifying a characteristic of said volume, and wherein said sensor supplies a sensor signal to said signal generator to set said drive signal dependent on said characteristic.

13. A hearing aid as claimed in claim 12 wherein said sensor is a sensor identifying a size of said volume.

14. A hearing aid as claimed in claim 12 wherein said sensor is a sensor which identifies a relative humidity in said volume.

15. A method for operating a hearing aid having a portion adapted for insertion in an auditory canal, and thereby closing a volume in said auditory canal between said portion and the tympanic membrane, comprising the steps of:

providing a first aeration channel and a second aeration channel each allowing communication of air between an exterior of said auditory canal and said volume;

providing an arrangement in said first aeration channel to promote a flow of air in a flow direction out of said volume;

providing an arrangement in said second aeration channel for promoting a flow of air in a flow direction into said second aeration channel;

converting incoming audio signals into an electrical signal with an acousto-electrical transducer in said hearing aid, processing said electrical signal with a processor in said hearing aid to produce a processed signal, converting said processed signal into an acoustic output in an electro-acoustical transducer in said hearing aid, and emitting said acoustic output into said auditory canal; and generating a drive signal in said hearing aid at an inaudible frequency and superimposing said drive signal on said processed signal for driving said electro-acoustical transducer, and emitting said drive signal as a component of said acoustical output into said auditory canal for promoting said flow of air in said flow directions into and out of said auditory canal for actively ventilating said auditory canal.

16. A method as claimed in claim 15 wherein said drive signal has an amplitude, and comprising the additional steps of:

identifying a characteristic of said electrical signal; and setting at least one of said amplitude and said frequency of said drive signal dependent on said characteristic.

17. A method as claimed in claim 16 comprising identifying an amplitude of said electrical signal as said characteristic.

18. A method as claimed in claim 15 comprising the additional steps of:

defining a threshold which avoids overdrive of said electro-acoustical transducer; and setting said drive signal so that said drive signal superimposed on said processed signal does not exceed said threshold.

19. A method as claimed in claim 18 wherein said signal processor is programmable, and comprising setting said threshold by programming said signal processor.

* * * * *